US011642898B2

(12) United States Patent
Otokita et al.

(10) Patent No.: US 11,642,898 B2
(45) Date of Patent: May 9, 2023

(54) PRINTING APPARATUS AND PRINTING METHOD

(71) Applicant: Seiko Epson Corporation, Tokyo (JP)

(72) Inventors: Kenji Otokita, Yamagata-mura (JP); Takahiro Imai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/555,646

(22) Filed: Dec. 20, 2021

(65) Prior Publication Data

US 2022/0194102 A1 Jun. 23, 2022

(30) Foreign Application Priority Data

Dec. 22, 2020 (JP) ..... JP2020-211966

(51) Int. Cl.
*B41J 11/00* (2006.01)

(52) U.S. Cl.
CPC .... *B41J 11/00212* (2021.01); *B41J 11/00214* (2021.01)

(58) Field of Classification Search
CPC ..... B41J 11/00212; B41J 11/00214; B41J 29/38; B41J 2025/008; B41J 29/377
See application file for complete search history.

(56) References Cited

U.S. PATENT DOCUMENTS

2013/0127962 A1* 5/2013 Yoda ..... B41J 11/0021 347/102

FOREIGN PATENT DOCUMENTS

JP 2013-107275 6/2013
WO 2016-182037 11/2016

* cited by examiner

*Primary Examiner* — Bradley W Thies
(74) *Attorney, Agent, or Firm* — Workman Nydegger

(57) ABSTRACT

A printer control unit controls a fan, based on an acquired reference temperature and an output of a sensor, to cause a temperature of a platen drum or a temperature of a sheet supported by the platen drum to be the reference temperature. Specifically, at step S100, the printer control unit acquires a type of the printing medium to be used for printing, acquires the reference temperature at step S110, and at step S150, controls an operating state of the fan, based on the temperature of the platen drum output by the sensor, such that the temperature of the platen drum becomes the reference temperature acquired at step S110. As a result, a temperature increase of the platen drum becomes substantially saturated at the targeted reference temperature.

7 Claims, 7 Drawing Sheets

| SUBSTRATE A | NUMBER OF FANS | | | | |
|---|---|---|---|---|---|
| PRINT DUTY | 0 | 1 | 2 | 3 | 4 |
| HIGH | 53°C | 52°C | 51°C | 50°C | 49°C |
| MEDIUM | 52°C | 51°C | 50°C | 49°C | 48°C |
| LOW | 49°C | 48°C | 47°C | 46°C | 45°C |

FIG. 5A

| SUBSTRATE B | NUMBER OF FANS | | | | |
|---|---|---|---|---|---|
| PRINT DUTY | 0 | 1 | 2 | 3 | 4 |
| HIGH | 55°C | 54°C | 53°C | 52°C | 51°C |
| MEDIUM | 52°C | 51°C | 50°C | 49°C | 48°C |
| LOW | 49°C | 48°C | 47°C | 46°C | 45°C |

FIG. 5B

| REFERENCE TEMPERATURE | TYPE OF PRINTING MEDIUM |
|---|---|
| A | 49°C |
| B | 51°C |
| C | 48°C |
| D | 50°C |

FIG. 5C

PRINTING APPARATUS AND PRINTING METHOD

The present application is based on, and claims priority from JP Application Serial Number 2020-211966, filed Dec. 22, 2020, the disclosure of which is hereby incorporated by reference herein in its entirety.

BACKGROUND

1. Technical Field

The present disclosure relates to technology for recording an image by curing, using light irradiation, a photocurable ink discharged onto a recording medium.

2. Related Art

When a recording medium is supported by a support body, and an image is recorded by curing, using light irradiation, a photocurable ink discharged onto the recording medium, the temperature of the recording medium and the support body increases due to the reaction heat.

The greater the change in the temperature of the recording medium and a drum of the support body, the greater a color difference becomes. This is because, when the temperature of the support body or the recording medium is high, fluidity of the ink after landing is high, and therefore, wet-spreading of the ink occurs more easily and the color becomes darker. Further, when the temperature of the support body and the recording medium is low, the fluidity of the ink after landing is low, and therefore, wet-spreading of the ink occurs less easily and the color becomes lighter.

For this reason, in International Patent Publication WO2016/182037, it is disclosed that the temperature of a transport surface of a transport drum is caused to be a predetermined temperature (45° C.) by heating means or cooling means before printing, and printing is started thereafter, and when a surface temperature of the recording medium is acquired during printing and the temperature has become higher than an upper limit temperature (50° C.), the printing is stopped and the transport drum is cooled.

Further, in JP-A-2013-107275, it is disclosed that the transport drum is cooled during printing also, in order to prevent a printed image quality from deteriorating as a result of wrinkles occurring due to differential shrinkage of a recording medium resulting from temperature distribution occurring as a result of an influence of reaction heat associated with a curing reaction of UV ink.

However, in the method disclosed in International Patent Publication WO2016/182037, printing efficiency deteriorates because printing interruptions occur whenever the temperature of the recording medium during printing exceeds an upper limit temperature. Here, by using the technology disclosed in JP-A-2013-107275 in International Patent Publication WO2016/182037, it is conceivable to perform temperature management to heat or cool the transport drum so as to maintain the temperature of the recording medium (the transport drum) during the printing to be within a predetermined range.

As a result of diligent experimentation by the present inventors, it was found that the temperature change of the recording medium and the support body (the transport drum) caused by the photocurable ink varies depending on an ejection amount of the ink for each of images to be printed (hereinafter, referred to as a print duty), and a temperature difference between an image of a low print duty and an image of a high print duty is 10° C. or more. If a large temperature difference occurs in the temperature of the recording medium between an image with a low print duty and an image with a high print duty, for example, when printing line images having the same line width, there is a risk that a defect may occur in which the line widths of the actually printed images differ between the image with the low print duty and the image with the high print duty.

Even when the technology disclosed in JP-A-2013-107275 is applied to International Patent Publication WO2016/182037, this simply means that a cooling fan is not operated when the temperature of the recording medium (the transport drum) is less than a threshold value, and the temperature of the recording medium is caused not to exceed a predetermined temperature by operating the cooling fan when the temperature exceeds the threshold temperature, and this has not been considered in terms of controlling the cooling fan so as to resolve issues of image quality differences occurring between the image with the low print duty and the image with the high print duty.

SUMMARY

According to an aspect of the present disclosure, a printing apparatus is configured to include a transport unit configured to transport a recording medium, a support unit configured to support the recording medium transported by the transport unit, a discharge unit located at a position facing the support unit, and configured to discharge photocurable ink onto the recording medium supported by the support unit, to form an image, a light irradiation unit configured to, downstream of the discharge unit on a transport path of the recording medium, irradiate, with light, the photocurable ink discharged onto the recording medium to cure the photocurable ink, a temperature adjustment unit configured to perform at least one of cooling or heating of the support unit, a measurement unit disposed at a position facing the support unit or the recording medium supported by the support unit, and configured to measure a temperature of the support unit or a temperature of the recording medium supported by the support unit, and output a measurement result, and a control unit. The control unit acquires a reference temperature to be a target temperature of the support unit or the recording medium supported by the support unit, and, based on the acquired reference temperature and the output from the measurement unit, adjusts a strength of the temperature adjustment unit to cause the temperature of the support unit or of the recording medium supported by the support unit to be the reference temperature.

In the above-described configuration, the target temperature during the printing of the support unit or the recording medium supported by the support unit, which has an influence on an image quality, is acquired as the reference temperature, and the temperature adjustment unit is controlled, based on the reference temperature and the output of the measurement unit, so that the temperature of the support unit or the recording medium supported by the support unit is the reference temperature.

Thus, according to the present disclosure, a uniform image quality can be achieved regardless of the print duty.

BRIEF DESCRIPTION OF THE DRAWINGS

FIG. 5A is a diagram showing the temperature of the platen drum when a number of fans being operated is changed in jobs with different print duties in three stages.

FIG. 5B is a diagram showing the temperature of the platen drum when the number of fans being operated is changed in the jobs with the different print duties in three stages.

FIG. 5C is a diagram showing relationships between types of a printing medium and reference temperatures.

DESCRIPTION OF EXEMPLARY EMBODIMENTS

An embodiment of the present disclosure will be described below with reference to the accompanying drawings.

Figure 1:
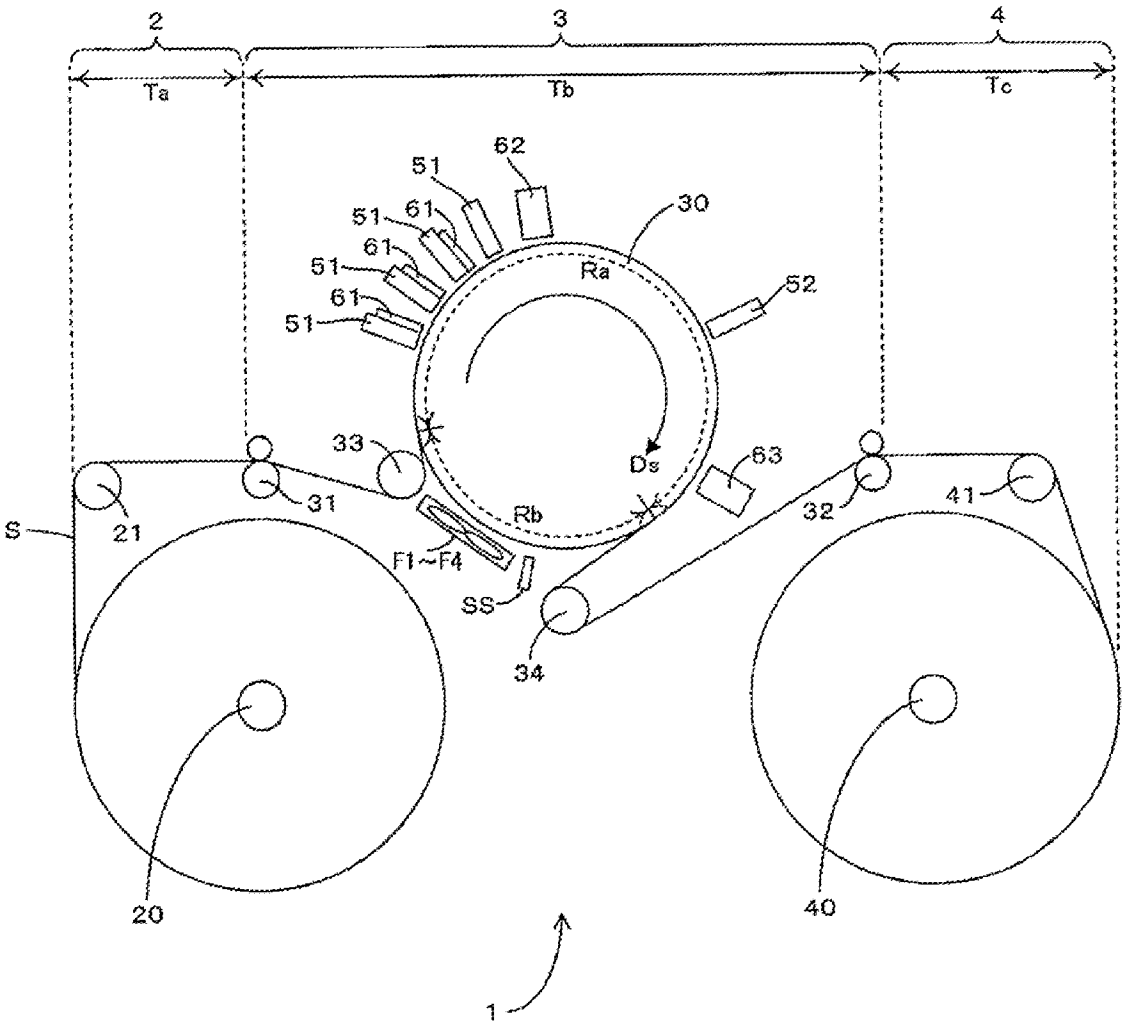
FIG. 1 is a front view illustrating an overview of a hardware configuration of a printer.

FIG. 1 is a front view illustrating an overview of a hardware configuration of a printer to which the present disclosure can be applied. As illustrated in FIG. 1, in a printer 1, a single sheet S, both ends of which are wound around a feeding shaft 20 and a winding shaft 40 in a roll shape, is stretched between the feeding shaft 20 and the winding shaft 40, and the sheet S is transported from the feeding shaft 20 to the winding shaft 40 along a path over which the sheet S is stretched in this manner. Then, in the printer 1, an image is recorded on the sheet S transported along this transport path. In overview, the printer 1 is provided with a feeding unit 2 that feeds out the sheet S from the feeding shaft 20, a process unit 3 that records the image on the sheet S fed out from the feeding unit 2, and a winding unit 4 that winds the sheet S, on which the image has been recorded in the process unit 3, around the winding shaft 40. Note that in the following description, of both surfaces of the sheet S, the surface on which the image is recorded will be referred to as a front surface and the surface on the reverse side of the front surface will be referred to as a back surface.

The feeding unit 2 includes the feeding shaft 20 around which the end of the sheet S is wound, and a driven roller 21 on which the sheet S drawn out from the feeding shaft 20 is wound. The feeding shaft 20 supports the sheet S by winding the end of the sheet S around the feeding shaft 20 with the front surface of the sheet S facing outward. Then, when the feeding shaft 20 rotates in the clockwise direction in FIG. 1, the sheet S wound around the feeding shaft 20 is fed out to the process unit 3 via the driven roller 21.

While supporting the sheet S fed out from the feeding unit 2 using a platen drum 30, the process unit 3 performs processing as appropriate, using each of functional units 51, 52, 61, 62, and 63 that are disposed along the outer circumferential surface of the platen drum 30, thus recording the image on the sheet S. In this process unit 3, a front driving roller 31 and a rear driving roller 32 are provided on both sides of the platen drum 30, and the sheet S transported from the front driving roller 31 to the rear driving roller 32 is supported by the platen drum 30 and is subjected to the image recording.

The platen drum 30 is a cylindrical drum supported so as to be able to rotate freely, and winds the sheet S transported from the front driving roller 31 to the rear driving roller 32 from the back surface side. In other words, the sheet S transported from the front driving roller 31 to the rear driving roller 32 is supported by the outer circumferential surface of the rotary drum 30. In this way, the front driving roller 31, the rear driving roller 32, and intermediate driven rollers 21, 33, 34, and 41 correspond to a transport unit that transports the recording medium. Further, the platen drum 30 corresponds to a support unit that supports the recording medium transported by the transport unit.

Then, in the process unit 3, in order to record a color image on the front surface of the sheet S supported by the platen drum 30, a plurality of the recording heads 51 corresponding to mutually different colors are provided. Specifically, four of the recording heads 51 corresponding to yellow, cyan, magenta, and black are aligned in this color order in a transport direction Ds. Each of the recording heads 51 faces the front surface of the sheet S wound on the platen drum 30 with a predetermined clearance therebetween, and discharges an ink of the corresponding color using an ink-jet method. Then, as a result of each of the recording heads 51 discharging the ink onto the sheet S transported in the transport direction Ds, the color image is formed on the front surface of the sheet S.

In this way, each of the recording heads 51 is located at a position facing the support unit, and corresponds to a discharge unit configured to discharge photocurable ink onto the recording medium supported by the support unit, to form the image.

As the ink, an ultraviolet (UV) ink (photocurable ink) that is cured by being irradiated with ultraviolet rays (light) is used. Here, in order to cure and fix the ink to the sheet S, the UV lamps 61 and 62 (a light irradiation unit) are provided in the process unit 3. Note that this ink curing is performed in two stages of provisional curing curing and final curing. The UV lamps 61 for the provisional curing are disposed in each of intervals between the plurality of recording heads 51. In other words, the UV lamps 61 are used for curing (provisional curing of) the ink to a degree such that the ink does not lose its shape, by irradiating the ink with relatively weak ultraviolet rays, and are not used for completely curing the ink. On the other hand, the UV lamp 62 for the final curing is provided downstream of the plurality of recording heads 61 in the transport direction Ds. In other words, the UV lamp 62 is used for completely curing (final curing of) the ink, by irradiating the ink with ultraviolet rays stronger than the ultraviolet rays of the UV lamps 61. In this way, the color image formed by the plurality of recording heads 51 can be fixed to the front surface of the sheet S by performing the provisional curing and the final curing.

As described above, the UV lamps 61 and the UV lamp 62 correspond to the light irradiation unit that irradiates the light onto and cures the photocurable ink discharged onto the recording medium, further downstream than the discharge unit on the transport path of the recording medium.

Note that the provisional curing and the final curing are performed in this example, but the curing is not necessarily performed in the two stages.

In general, when the photocurable ink is irradiated with the ultraviolet rays, reaction heat is generated. Thus, a site of the sheet S (the recording medium) at which the ink is adhered generates heat, and as a result of that heat being transferred to the platen drum 30, the temperature of the platen drum 30 increases. In this case, strictly speaking, a temperature difference occurs between the sheet S and the platen drum 30, but in this example, processing is performed on the assumption that the temperature of both the sheet S and the platen drum 30 is roughly the same. As described above, temperature information relating to the temperature of the recording medium of the present disclosure is information about the temperature of the recording medium or the support unit.

In order to suppress an increase in the temperature due to this heat generation, a plurality of fans F1 to F4 are provided as a cooling mechanism for cooling the platen drum 30. Each of the fans F1 to F4 can be turned on and off individually, and a cooling intensity can be changed in a stepwise manner depending on a number of the fans that are operated.

In this way, each of the fans F1 to F4 corresponds to a temperature adjustment unit capable of cooling the support unit. In the embodiment, the cooling is performed, but a configuration can be adopted in which heating is performed in addition to the cooling, or in which the heating is performed.

The recording head 52 is provided downstream of the UV lamp 62 in the transport direction Ds. This recording head 52 faces the front surface of the sheet S wound on the platen drum 30 with a predetermined clearance therebetween, and discharges a transparent UV ink onto the front surface of the sheet S, using an ink-jet method. In other words, the transparent ink is further discharged onto the color image formed by the recording heads 51 of the four colors. Further, the UV lamp 63 is provided downstream of the recording head 52 in the transport direction Ds. This UV lamp 63 is used for completely curing (final curing of) the transparent ink discharged by the recording head 52, by irradiating the transparent ink with strong ultraviolet rays. In this way, the transparent ink can be fixed to the front surface of the sheet S.

As described above, the sheet S is supported by being wound around the platen drum 30. The sheet S wound around a winding portion Ra of the outer circumferential surface of the platen drum 30 in this manner is irradiated with the ultraviolet rays, to cure the UV ink that has landed on the front surface of the sheet S. Then, in the process unit 3, in order to suppress an increase in the temperature of the UV ink at that time, the platen drum 30 is cooled to cause the heat generated by the UV ink to escape to the platen drum 30.

Next, an electrical configuration for controlling the printer 1 will be described.

Figure 2:
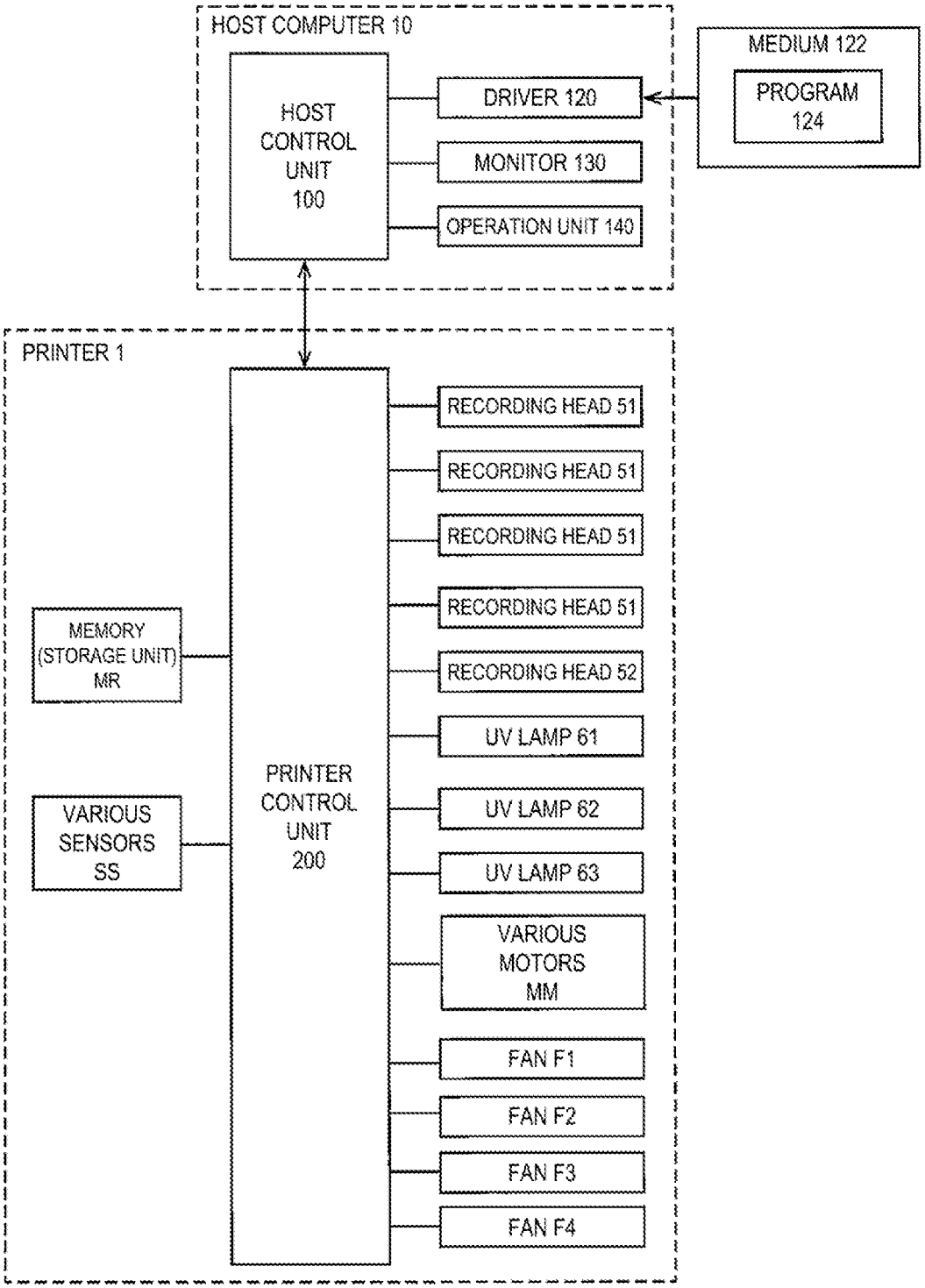
FIG. 2 is a block diagram schematically illustrating an electrical configuration for controlling the printer.

FIG. 2 is a block diagram schematically illustrating the electrical configuration for controlling the printer illustrated in FIG. 1. The operations of the printer 1 described above are controlled by a host computer 10 illustrated in FIG. 2. In the host computer 10, a host control unit 100 that manages control operations is configured by a central processing unit (CPU) and a memory. Further, a driver 120 is provided in the host computer 10, and the driver 120 reads out a program 124 from a medium 122. Note that various devices can be used as the medium 122, such as a compact disk (CD), a digital versatile disk (DVD), a universal serial bus (USB) memory, and the like. Then, the host control unit 100 controls each of units of the host computer 10 and controls the operations of the printer 1 based on the program 124 read out from the medium 122.

Furthermore, as an interface with an operator, the host computer 10 is provided with a monitor 130 configured by a liquid crystal display and the like, and an operation unit 140 configured by a keyboard, a mouse, and the like. In addition to an image to be printed, a menu screen is displayed on the monitor 130. Therefore, by operating the operation unit 140 while viewing the monitor 130, the operator can open a printing setting screen from the menu screen, and can set various printing conditions, such as a type of the printing medium, a size of the printing medium, a printing quality, and the like. Note that various modifications are possible in the specific configuration of the interface with the operator. For example, a touch panel type display may be used as the monitor 130, and the operation unit 140 may be configured by the touch panel of the monitor 130.

On the other hand, the printer 1 is provided with a printer control unit 200 that controls each of the units of the printer 1 in accordance with commands from the host computer 10. Then, the recording heads, the UV lamps, and each of the device units of the sheet transport system are controlled by the printer control unit 200. Details of the control by the printer control unit 200 for each of the device units are as follows. The printer control unit 200 is provided with a memory MR as a storage unit. Note that the printer control unit 200 corresponds to a control unit of the present disclosure.

The printer control unit 200 has a function of controlling the transport of the sheet S described above in detail with reference to FIG. 1. In other words, a motor is connected to each of the feeding shaft 20, the front driving roller 31, the rear driving roller 32, and the winding shaft 40, of the members configuring the sheet transport system. Then, using detection results of various sensors SS, the printer control unit 200 controls the speed and torque of each of motors MM while rotating the motors MM, thus controlling the transport of the sheet S. One function of the sensors SS is the function of a temperature sensor that measures the temperature of the platen drum 30. Further, the sensors SS correspond to a temperature measuring unit that measures and outputs the temperature of the platen drum 30 or the platen drum 30.

Figure 3:
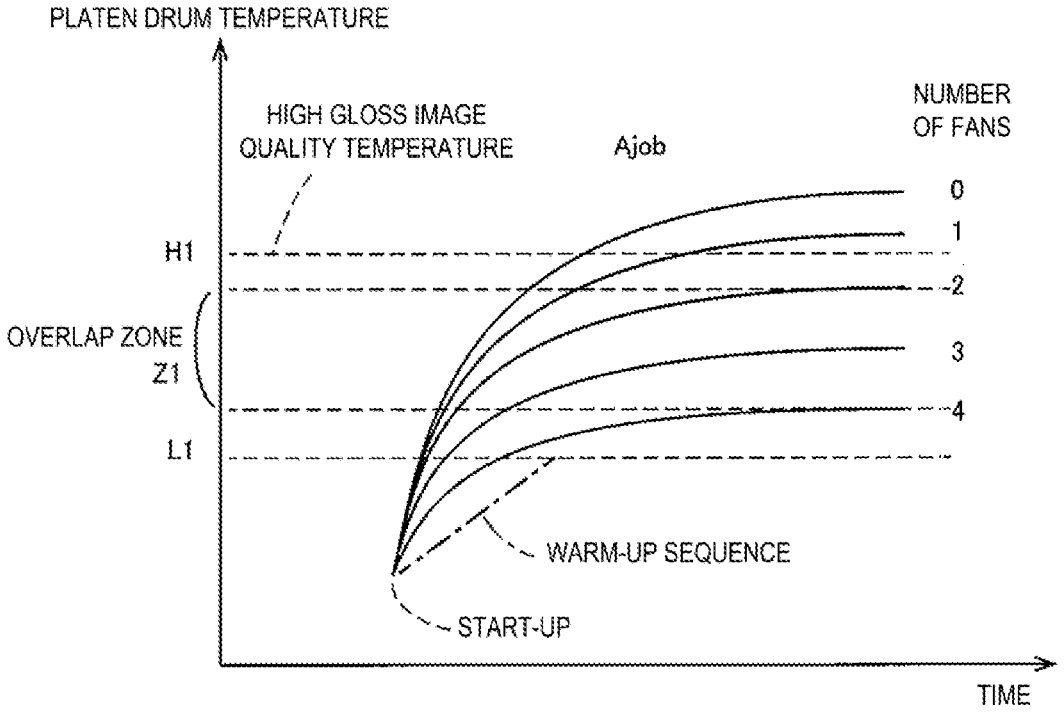
FIG. 3 is a diagram showing a relationship between a strength of a temperature adjustment unit and a temperature of a platen drum in a job with a high print duty.
Figure 4:
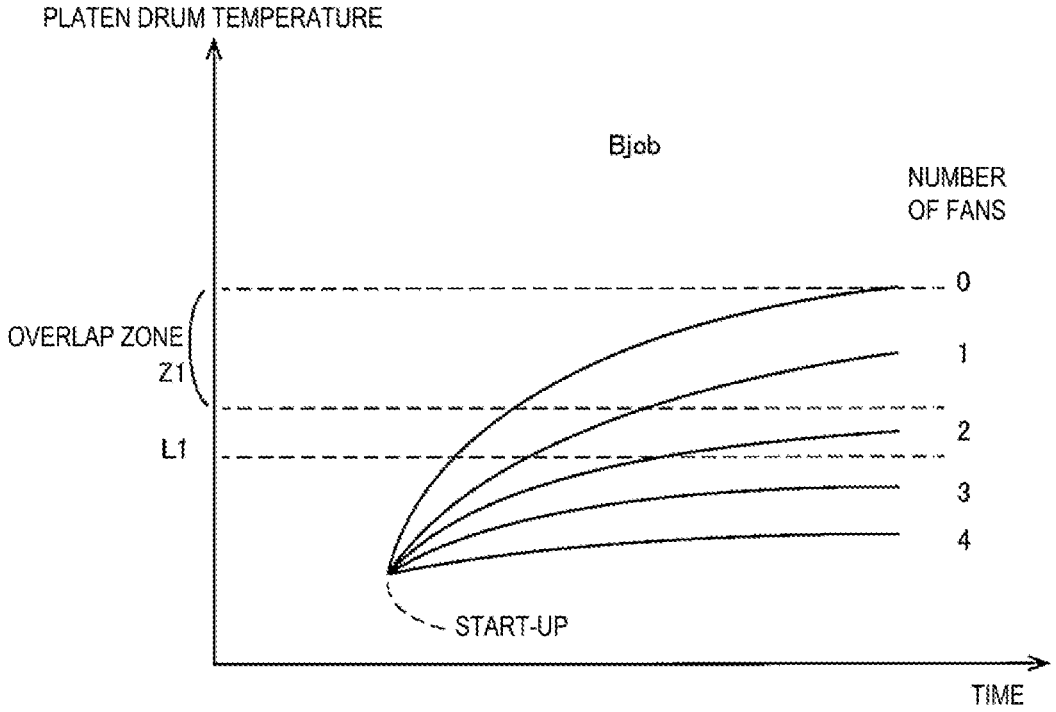
FIG. 4 is a diagram showing the relationship between the strength of the temperature adjustment unit and the temperature of the platen drum in a job with a low print duty.

FIG. 3 and FIG. 4 are graphs showing changes in the temperature of the platen drum 30 when the number of the fans F1 to F4, which are the temperature adjustment unit, are changed when performing two jobs (a job A and a job B) having different print duties. There are various definitions of the print duty and the definition is not particularly limited. In the present disclosure, the definition uses an amount of ink used per unit area as a reference. Since the amount of reaction heat is believed to be substantially proportional to the amount of ink, it is conceivable that the amount of heat generation increases in accordance with the amount of ink used. When this is considered to be the amount of heat generation that increases the temperature of the platen drum 30, it is conceivable that this is proportional to the amount of ink used, and can be considered to be a total amount of the ink rather than the amount of ink per unit area. On the other hand, if the width of the sheet S is constant, the amount of ink used per unit area may be determined. When an ambient temperature is assumed at start-up, due to the heat reaction generated by irradiating the photocurable ink with the ultraviolet rays, when the printing is continuously performed, the temperature of the platen drum 30 increases. However, there is also an effect of natural heat dissipation and the temperature increase becomes saturated in accordance with each of the print duties, and a constant temperature is maintained.

When the number of fans is zero, the temperature increase is highest, and as the number of fans F1 to F4 operated is increased, a saturation temperature decreases in a stepwise manner. This is because a forced heat dissipation effect occurs. As described above, the wet-spreading of the ink varies depending on the temperature of the printing medium or the support body, and this variation affects the image quality. Thus, if the temperature adjustment unit is caused to have a constant strength, the temperature of the platen drum 30 differs between the job A and the job B. On the other hand, when the number of fans F1 to F4, which are the temperature adjustment unit, is changed in accordance with the print duty, the temperature of the platen drum 30 can be caused to be matched or approximated in each of the jobs. For example, the temperature of the platen drum 30 is substantially the same when the number of fans operated is three in the job A and the number of fans operated is one in the job B.

Further, when described from another perspective, there is a band in which ranges of the temperature change of the platen drum 30 in the job A and the job B match each other. When this is referred to as an overlap zone, if a range of the number of fans in the job A is two to four, and a range of the number of fans in the job B is zero to two (illustrated by an overlap zone Z1 in the drawings), the temperature of the platen drum 30 can be caused to match. Thus, if the temperature of the overlap zone Z1 is defined as a reference temperature, a common image quality can be achieved between the job A and the job B. As will be described below, in this example, the reference temperature with which a given image quality can be obtained is set, and feedback control is performed for the strength of the temperature adjustment unit based on an output of the sensors SS (the temperature sensor), such that the temperature of the platen drum 30 is the reference temperature. Here, limiting the temperature of the platen drum 30 to the reference temperature means limiting the image quality, and as a result, in the plurality of jobs having the different print duties, if the reference temperature is caused to be the same, this means that the same image quality can be obtained.

In this way, in a range of changes in the print duty, there is a range of overlap between the ranges in which the temperature can be adjusted by the temperature adjustment unit, and if the range of the reference temperature is limited to this range, the image quality can be made the same in the ranges of all the print duties.

Further, although the same image quality cannot be obtained over a wide range of the print duties in this way, as shown in FIG. 3, when the temperature of the platen drum 30 with which the high gloss image quality in the job A is obtained is assumed to be H1, the reference temperature can also be set to be H1. In this case, even though the same image quality cannot be provided in the job B, if another job is executed that has a print duty between those of the job A and the job B, the same high gloss image quality can be provided even in a range exceeding this overlap zone Z1.

FIG. 5A and FIG. 5B are tables showing the temperature of the platen drum 30 when jobs with print duties differing in three stages are executed and the number of fans F1 to F4 operating in each case is changed, and the tables show results acquired in advance by testing using the printer 1. FIG. 5A shows results relating to the printing medium that is a type A printing medium, and FIG. 5B shows results relating to the printing medium that is a type B printing medium. This table is used to determine the reference temperature and, as shown in FIG. 5A, when there is a common temperature in all the different print duties (in this example, 49° C. corresponds to the common temperature), if that temperature is set as the reference temperature, the same image quality can be obtained in any one of the different print duties.

On the other hand, as shown in FIG. 5B, when there is no common temperature in all the different print duties (in this example, 51° C. is common between the high and medium print duties, but since there is no 51° C. in the low print duty, there is no common temperature), a temperature for which a temperature difference is as small as possible between the different print duties is set as the reference temperature. This table is created for each of the types of printing medium that can be used in the printer 1. Further, the relationships corresponding to the created table are stored in the memory MR. Note that, in order to simplify processing, the reference temperature for each type of the printing medium is set in advance based on the table created for each type of the printing medium, such as in FIG. 5A and FIG. 5B, and at the same time, this relationship between the type of the printing medium and the reference temperature is stored in the memory MR in advance. In this case, at the time of printing, when the reference temperature is set based on the relationship between the type of the printing medium and the reference temperature which is stored in the memory MR, and on the type of the printing medium to be used, the relationships of the table shown in FIG. 5A need not necessarily be stored in the memory MR. Alternatively, as will be described below, when the reference temperature is input by a user via the operation unit 140 also, the relationships of the table shown in FIG. 5A need not necessarily be stored in the memory MR. FIG. 5C is an example of a table showing the relationships between the types of the printing medium and the reference temperatures.

As shown in FIG. 5A, for example, when the temperature of the platen drum 30 is 49° C., this corresponds to when the print duty is highest and the number of fans operating is the maximum number of four. When it is this temperature, this also matches the temperature of the platen drum 30 when the print duty is medium and the number of fans is three, and the temperature of the platen drum 30 when the print duty is low and the number of fans is zero. Thus, if the reference temperature is set to 49° C., the image quality can be caused to be the same in any of the print duties.

On the other hand, as shown in FIG. 5B, for example, when the temperature of the platen drum 30 is 51° C., this corresponds to when the print duty is highest and the number of fans operating is the maximum number of four. When it is this temperature, this also matches the temperature of the platen drum 30 when the print duty is medium and the number of fans is one. Note that, when the print duty is low, there is no precisely matching temperature, but since the temperature of the platen drum 30 is 49° C. when the number of fans is zero, this can be considered to be a tolerance within an acceptable range. Further, when the temperature of the platen drum 30 is 49° C., this corresponds to when the print duty is medium and the number of fans operating is three. When it is this temperature, this also matches the temperature of the platen drum 30 when the print duty is low and the number of fans is zero.

Note that, when the print duty is high, there is no precisely matching temperature, but since the temperature of the platen drum 30 is 51° C. when the number of fans is four, this can be considered to be a tolerance within an acceptable range. Further, when the temperature of the platen drum 30 is 50° C., this corresponds to when the print duty is medium and the number of fans operating is two. In the case of this temperature, both when the print duty is high and when the print duty is low, there is no precisely matching temperature, but since the temperature of the platen drum 30 is 51° C. when the print duty is high and the number of fans is four, and the temperature of the platen drum 30 is 49° C. when the print duty is low and the number of fans is zero, these can be considered to be tolerances within an acceptable range. In this type of case, the user may determine which of the temperatures is to be set as the reference temperature as appropriate, based on a priority ranking. Examples of the priority ranking include a desired image quality, a power consumption of the printer 1, the print duty of a job to be printed immediately afterward, and the like. Further, when there are a plurality of temperatures of the platen drum 30 that are common to all of the print duties in the single table, the user may also determine which of the temperatures is to be set as the reference temperature as appropriate, based on the priority ranking. Further, a configuration may be adopted in which the determination of the reference temperature based on the priority ranking is performed by the printer control unit 200. In this case, the priority ranking is stored in the memory MR.

By performing the feedback control of the temperature adjustment unit for each of the print duties based on the reference temperature set in this way, the image quality can be caused to be the same over a wide range of the print duties.

Next, operations of this embodiment having the configuration described above will be described.

Figure 6A:
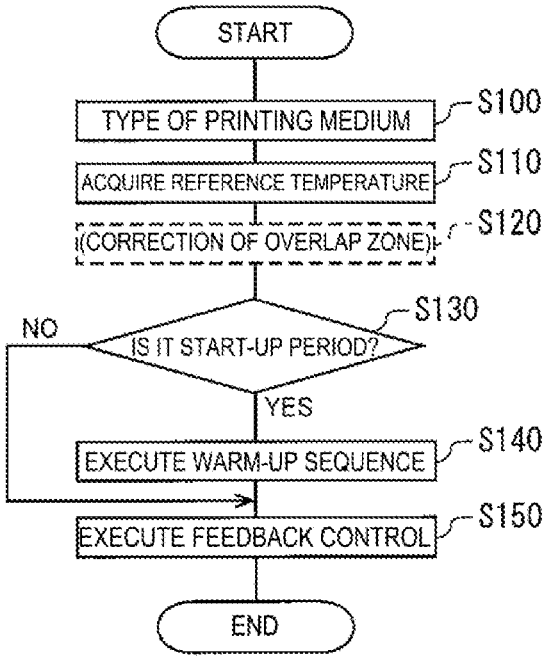
FIG. 6A is a flowchart of a printer control unit.

FIG. 6A is a flowchart of the printer control unit, when the reference temperature is set by user input.

At step S100, the printer control unit 200 acquires the type of the printing medium to be used for printing. The type of the printing medium is acquired by an appropriate method, such as displaying a predetermined input field on the monitor 130 and the user inputting the type via the operation unit 140, or by acquiring the type of the printing medium included in print data.

The printer control unit 200 acquires the reference temperature at step S110. The reference temperature is a target temperature when forming an image using the printer 1, and the printer control unit 200 displays, on the monitor 130, a table corresponding to the acquired type of the printing medium, prompts an input from the user via the operation unit 140, and acquires the reference temperature, which is temperature information. The table is stored in the memory MR.

This table indicates either one or both of a relationship between three factors of A1) the print duty of the image, A2) the strength of the temperature adjustment unit, and A3) the temperature information associated with the temperature of the recording medium, or a relationship formula representing the relationship between three factors of B1) the print duty of the image, B2) the strength of the temperature adjustment unit, and B3) the temperature information.

Specifically, with reference to FIG. 5A, the print duty in the left field of the diagram corresponds to A1) and B1), namely, the print duty of the image, the number of fans in the top row corresponds to A2) and B2), namely, the strength of the temperature adjustment unit, and the temperature of each of the types in the table corresponds to A3) and B3), namely, the temperature information. Thus, the table of these three factors, or the relationship formula determining the relationship between these factors by mathematical calculation is stored in the memory MR.

Note that the method of using the monitor 130 and the operation unit 140 corresponds to a case in which the reference temperature, as the temperature information that is the target temperature, is input via a predetermined user interface.

When the reference temperature is limited to the overlap zone as described above, at step S120, the printer control unit 200 determines whether the input reference temperature is within the range of the overlap zone Z1 described above, and if the reference temperature is outside the range, the printer control unit 120 performs processing to prompt re-input of the reference temperature, to decrease the reference temperature to the upper limit of the overlap zone Z1 when the upper limit is exceeded, or to raise the reference temperature to the lower limit of the overlap zone Z1 when the lower limit has not been reached. Note that when the content of the jobs is determined in advance, the print duty for each of the jobs may be determined, and the overlap zone Z1 may be set each time, based on all of the print duties.

Next, in this example, the temperature adjustment unit is constituted by the cooling unit of the cooling fans F1 to F4 only, but a heating unit may be provided, or the temperature adjustment unit may be configured to be able to perform the heating and cooling by combining both the cooling unit and the heating unit. Further, it is also possible to increase a number of strengths that can be set by changing and combining the strengths of the cooling unit and the heating unit.

Incidentally, since the reaction heat occurs and reaches saturation each time the printing is performed, during a period in which the initial ambient temperature reaches the saturation temperature, the temperature of the platen drum 30 does not reach an expected temperature. Thus, at step S130, the printer control unit 200 determines whether or not the period is this type of startup period, and when it is determined that it is the startup period, at step S140, the printer control unit 200 executes a warm-up sequence. The warm-up sequence is processing that boosts the temperature increase of the platen drum 30, and various methods can be implemented, such as using a heater, or discharging the ink onto a non-printing range to increase the total amount of ink.

Subsequently, at step S150, the printer control unit 200 performs the feedback control of the temperature adjustment unit. This feedback control controls operating conditions of the temperature adjustment unit, namely, operating conditions of the fans F1 to F4, based on the temperature of the platen drum 30 output by the sensors SS, so that the temperature of the platen drum 30 becomes the reference temperature acquired at step S110.

By performing the above processing, the temperature increase of the platen drum 30 becomes substantially saturated at the target reference temperature.

In this way, in the present disclosure, the target temperature of the platen drum during the printing that is common to the different print duties, or in which the temperature difference of the temperature of the platen drum between the different print duties becomes small is considered to be the reference temperature, and the feedback control of the temperature adjustment unit is performed based on the reference temperature and the temperature of the platen drum 30 output by the sensors SS.

In the flowchart illustrated in FIG. 6A, the table corresponding to the type of the printing medium is displayed on the monitor 130, and the reference temperature, which is the temperature information, input from the user via the operation unit 140 is acquired, but the reference temperature may be input from the user via the operation unit 140 without displaying the table on the monitor 130. In this case, the user views a separately printed table or a table displayed on another display device, and inputs the reference temperature.

Furthermore, a configuration may be adopted in which the printer control unit 200 automatically sets the reference temperature based on the type of the printing medium acquired at step S100, on the table corresponding to the type of the printing medium, that is the table indicating either one of or both the relationships between A1) the print duty of the image, A2) the strength of the temperature adjustment unit, and A3) the temperature information relating to the temperature of the printing medium, and the table indicating the relationship formula between B1) the print duty of the image, B2) the strength of the temperature adjustment unit, and B3) the temperature information, and on the predetermined priority ranking stored in the memory MR. In this case step S120 is not performed, and step S130 is performed subsequently to step S110.

Figure 6B:
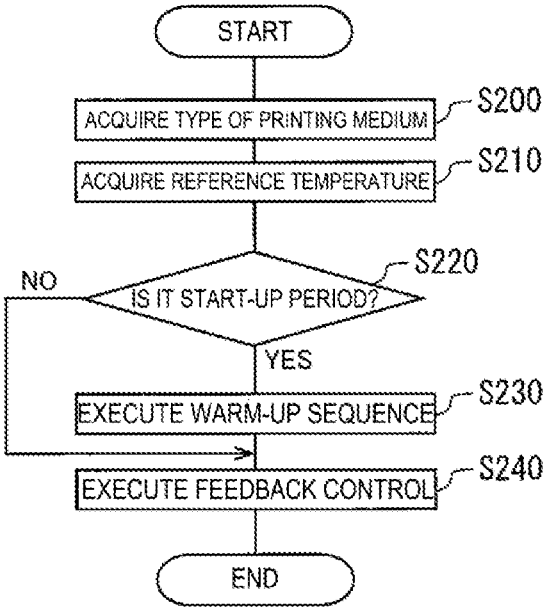
FIG. 6B is a flowchart of the printer control unit.

FIG. 6B is a flowchart of the printer control unit when the reference temperature is acquired based on the type of the printing medium and a table showing the relationship between the type of the printing medium and the reference temperature.

At step S200, the printer control unit 200 acquires the type of the printing medium to be used for printing. The type of the printing medium is acquired by an appropriate method, such as displaying a predetermined input field on the monitor 130 and the user inputting the type via the operation unit 140, or by acquiring the type of the printing medium included in the print data.

At step S210, the printer control unit 200 acquires the reference temperature. The reference temperature is the target temperature when forming the image using the printer 1, and the printer control unit 200 acquires the reference temperature, which is the temperature information, based on the type of the printing medium acquired at step S200 and on the table. The table is stored in the memory MR.

This table is a table showing a relationship between C1) the type of the printing medium and C2) the reference temperature. Specifically, with reference to FIG. 5C, the type of the printing medium in the left field of the diagram corresponds to C1) the type of the printing medium, and the reference temperature in the right field of corresponds to C2) the reference temperature. Thus, this type of the table is stored in the memory MR.

Note that the method for using the type of the printing medium and the relationship between the type of the printing medium and the reference temperature corresponds to a case in which the reference temperature is stored in the storage unit, where the reference temperature is the temperature information serving as the target temperature. Subsequently, at step S220, the printer control unit 200 determines whether or not the temperature of the platen drum 30 is in the startup period during which the initial ambient temperature reaches the saturation temperature, and when it is determined to be the startup period, executes the warm-up sequence at step S230. The warm-up sequence is the processing that boosts the temperature increase of the platen drum 30, and various methods can be implemented, such as using the heater, or discharging the ink onto the non-printing range to increase the total amount of ink.

Subsequently, at step S240, the printer control unit 200 performs the feedback control of the temperature adjustment unit. This feedback control controls the operating conditions of the temperature adjustment unit, namely, the operating conditions of the fans F1 to F4, based on the temperature of the platen drum 30 output by the sensors SS, so that the temperature of the platen drum 30 becomes the reference temperature acquired at step S210.

By performing the above processing, the temperature increase of the platen drum 30 becomes substantially saturated at the target reference temperature.

Note that at step S150 and step S240, the printer control unit 200 acquires and sets an appropriate voltage of an applied voltage (VH) to be applied to the piezoelectric elements of the nozzles as described below, based on the temperature of the platen drum 30 output by the sensors SS.

Figure 7:
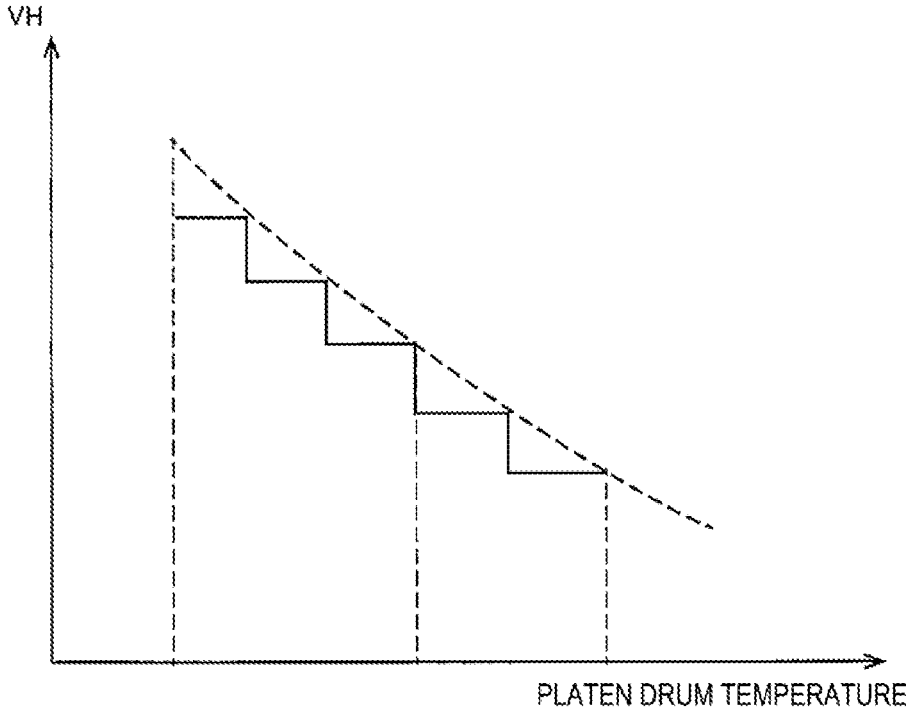
FIG. 7 is a diagram illustrating a relationship between the temperature of the platen drum and an applied voltage.

FIG. 7 is a diagram illustrating a relationship between the platen drum temperature and the applied voltage. In FIG. 7, the vertical axis shows the applied voltage (VH) applied to the piezoelectric elements of the nozzles that discharge the light curable ink droplets at the discharge unit, and the horizontal axis shows the temperature of the platen drum 30. A solid line shows the applied voltage (VH) that is changed in a stepwise manner, and a dashed line shows ideal values.

For example, when the temperature of the platen drum is high, the viscosity of the ink at landing tends to decrease and the wet-spreading becomes more likely. Thus, a line width tends to increase (blurring tends to occur). When the applied voltage (VH) is lowered, the ink discharge amount decreases, and the line width becomes narrower even when the wet-spreading of the ink occurs in the same way.

Conversely, when the temperature of the platen drum is low, the viscosity of the ink at the time of landing tends to increase and the wet-spreading becomes less likely. Thus, the line width tends to become thinner. In such a case, when the applied voltage (VH) is increased, the ink discharge amount increases, and even in the same state in which the wet-spreading is less likely, the line width becomes thicker.

In this way, by appropriately controlling the applied voltage applied to the piezoelectric elements and by keeping a dot diameter and the line width constant, it is possible to reduce a deterioration in image quality due to the effect of the wet-spreading of the dots.

In the example shown in FIG. 7, the applied voltage is varied in multiple stages depending on the temperature of the platen drum 30, but it is also possible to divide the temperature of the platen drum 30 into three stages of high, medium, and low, and to apply the appropriate voltage of the applied voltage in each case, that is, in three steps of (standard value −5%), standard value, and (standard value+5%).

As described above, the printer including the printer control unit 200 can be understood to be a printing apparatus of the present disclosure, and it goes without saying that each step of the processing that is performed in a chronological manner by the printer control unit 200, as illustrated in FIGS. 6A and 6B, can be understood to be a printing method of the present disclosure.

In other words, in the printer according to the example, it can be said that the following are performed: acquiring the reference temperature to be the target temperature of the support unit or the recording medium supported by the support unit, and, based on the acquired reference temperature and the output from the measurement unit, adjusting the strength of the temperature adjustment unit to cause the temperature of the support unit or of the recording medium supported by the support unit to be the reference temperature.

Note that it goes without saying that the present disclosure is not limited to the examples described above. It goes without saying that a person skilled in the art acknowledges that each of the following is disclosed as an example of the present disclosure:

Changing and applying, as appropriate, combinations of mutually replaceable members, configurations and the like disclosed in the above-described examples;

Replacing, or changing combinations of, and applying, as appropriate, the members, configurations, and the like disclosed in the above-described examples with members, configurations, and the like that are mutually replaceable therewith and that are known technologies although not disclosed in the above-described examples; and Replacing, or changing combinations of, and applying, as appropriate, the members, configurations, and the like disclosed in the above-described examples with members, configurations, and the like that, although not disclosed in the examples described above, are conceivable by a person skilled in the art, based on known technologies, as substitutes for the members, configurations, and the like disclosed in the above-described examples.

What is claimed is:

1. A printing apparatus comprising:

a transport unit configured to transport a recording medium;

a support unit configured to support the recording medium transported by the transport unit;

a discharge unit located at a position facing the support unit, and configured to discharge photocurable ink onto the recording medium supported by the support unit, to form an image;

a light irradiation unit configured to, downstream of the discharge unit on a transport path of the recording medium, irradiate, with light, the photocurable ink discharged onto the recording medium to cure the photocurable ink;

a temperature adjustment unit configured to perform at least one of cooling or heating of the support unit;

a measurement unit disposed at a position facing the support unit or the recording medium supported by the support unit, and configured to measure a temperature of the support unit or a temperature of the recording medium supported by the support unit, and output a measurement result; and a control unit, wherein the control unit acquires a reference temperature to be a target temperature of the support unit or the recording medium supported by the support unit, and, based on the acquired reference temperature and the output from the measurement unit, adjusts a strength of the temperature adjustment unit to cause the temperature of the support unit or of the recording medium supported by the support unit to be the reference temperature.

2. The printing apparatus according to claim 1, wherein the reference temperature is input via a user interface.

3. The printing apparatus according to claim 1, comprising:

a storage unit configured to store a relationship between a type of the recording medium and the reference temperature associated with each type of the recording medium; and a user interface, wherein the control unit acquires the reference temperature based on the type of the recording medium input via the user interface and on the relationship stored in the storage unit.

4. The printing apparatus according to claim 1, comprising:

a storage unit configured to store at least one of a relationship between three factors of a print duty of the image, a strength of the temperature adjustment unit, and the temperature of the recording medium or the temperature of the support unit, or a relationship formula representing the relationship of the three factors of the print duty of the image, the strength of the temperature adjustment unit, and the temperature of the recording medium or the temperature of the support unit, wherein the control unit acquires a priority ranking for determining the reference temperature, and acquires the reference temperature based on the relationship or the relationship formula and on the priority ranking.

5. The printing apparatus according to claim 4, wherein the priority ranking is input via a user interface.

6. The printing apparatus according to claim 4, wherein the priority ranking is stored in the storage unit.

7. A printing method for a printing apparatus including a transport unit configured to transport a recording medium, a support unit configured to support the recording medium transported by the transport unit, a discharge unit located at a position facing the support unit, and configured to discharge photocurable ink onto the recording medium supported by the support unit, to form an image, a light irradiation unit configured to, downstream of the discharge unit on a transport path of the recording medium, irradiate, with light, the photocurable ink discharged onto the recording medium to cure the photocurable ink, a temperature adjustment unit configured to perform at least one of cooling or heating of the support unit, a measurement unit disposed at a position facing the support unit or the recording medium supported by the support unit, and configured to measure a temperature of the support unit or a temperature of the recording medium supported by the support unit, and output a measurement result, and a control unit, the printing method comprising:

acquiring a reference temperature to be a target temperature of the support unit or the recording medium supported by the support unit, and based on the acquired reference temperature and the output from the measurement unit, adjusting a strength of the temperature adjustment unit to cause the temperature of the support unit or of the recording medium supported by the support unit to be the reference temperature.

* * * * *